United States Patent [19]

Walkup et al.

[11] Patent Number: 4,659,155

[45] Date of Patent: Apr. 21, 1987

[54] BACKPLANE-DAUGHTER BOARD CONNECTOR

[75] Inventors: William B. Walkup, Amherst, N.H.; William Chow, San Jose; Garry C. Gillette, Calabasas, both of Calif.

[73] Assignee: Teradyne, Inc., Boston, Mass.

[21] Appl. No.: 799,492

[22] Filed: Nov. 19, 1985

[51] Int. Cl.[4] ..... H01R 4/66

[52] U.S. Cl. ..... 339/14 R

[58] Field of Search ..... 339/14, 17 LM, 17 LC

[56] References Cited

U.S. PATENT DOCUMENTS

| | | | |
|---|---|---|---|
| 3,334,325 | 8/1967 | Conrad et al. | 339/14 R |
| 3,399,372 | 8/1968 | Uberbacher | 339/14 R X |
| 3,660,803 | 5/1972 | Cooney | 339/17 LM X |
| 4,223,968 | 9/1980 | Kawabata et al. | 339/14 R |

OTHER PUBLICATIONS

Pending U.S. Appln., U.S. Ser. No. 828,100, filed Feb. 10, 1986, continuation of U.S. Ser. No. 641,915, filed Aug. 17, 1984.

Teradyne Technical Bulletin 237, p. 8, with 339-17.LC and 1-29-1985 noted on it.

*Primary Examiner*—Eugene F. Desmond

[57] ABSTRACT

A connector assembly for connecting a daughter printed circuit board having an internal ground plane layer to a backplane including a daughter board connector element including a plurality of first signal contacts connected to signal lines on a surface of the daughter board near the bottom of the daughter board, the signal contacts extending outward from the surface and downward, and a ground contact electrically connected to the internal ground plane layer, the ground contact extending along the bottom of the daughter board so as to overlap a plurality of the signal contacts and having an elongated exposed lower contacting portion, and a backplane connector element including a plurality of second signal contacts arranged for mating with respective first signal contacts and an elongated bus bar aligned for contacting the mating portion.

9 Claims, 2 Drawing Figures

BACKPLANE-DAUGHTER BOARD CONNECTOR

FIELD OF THE INVENTION

The invention relates to a connector for connecting a daughter printed circuit board having an internal ground plane layer to a backplane.

BACKGROUND OF THE INVENTION

Backplanes are printed circuit boards or metal plates on the upper sides of which daughter boards are detachably mounted perpendicular to the backplanes for easy removal. One way of electrically connecting a daughter board to another daughter board, the backplane, and other circuitry is by a two-piece multiple contact connector consisting of a backplane connector element that is attached to the backplane and a mating daughter board connector element that is attached to the daughter board and fits between upwardly extending sidewalls of the backplane connector element. When the two elements are joined, the plurality of rows of post contacts directed upwardly between the sidewalls of the backplane connector element are connected to a plurality of corresponding downwardly directed forked contacts of the daughter board connector element.

In High Density Plus backplane-daughter board connectors manufactured by Teradyne Connection Systems, Inc., additional flat ground contacts are carried by the wall of the daughter board connector element and are contacted by discrete upwardly directed contact portions of ground contacts carried by the facing wall of the backplane connector element. Projections of the flat ground contacts and the ends of the forked contacts are secured in rows of holes that pass through the daughter board.

Some daughter boards have internal ground plane layers precisely spaced from the signal lines on their surfaces in order to have controlled impedance (to reduce signal reflection caused by changes in impedance) and reduced inductance in the ground path during high-speed switching. The internal ground plane layers have been electrically connected to backplanes through plural mating pairs of forked contacts and post contacts, and also through the flat ground contacts of the High Density Plus connectors.

SUMMARY OF THE INVENTION

We have discovered that an internal ground plane layer of a daughter board can be electrically connected to a backplane by using a ground contact that extends along the bottom of the daughter board, overlaps a plurality of signal contacts and directly contacts an aligned upstanding elongated bus bar mounted on the backplane, to provide reduced impedance changes (and thus reduced reflection) and reduced inductance in the ground path in the connector as well as the daughter board.

In preferred embodiments the ground contact is electrically connected to the internal ground plane layer by a conductor printed on the surface of the daughter board along its bottom; there are signal contacts connected to and extending down from both sides of the daughter board, and the ground contact passes between the signal contacts on both sides, eliminating crosstalk between the contacts on opposite sides of the board; there are two internal ground plane layers and two ground contacts on the connector element; and the ground contact has a curved contacting portion at its lower end for engaging the bus bar on the backplane.

Other features and advantages of the invention will be apparent from the following description of the preferred embodiment of the invention and from the claims.

DESCRIPTION OF THE PREFERRED EMBODIMENT

The drawings will be briefly described first.

DRAWINGS

STRUCTURE

Figure 1:
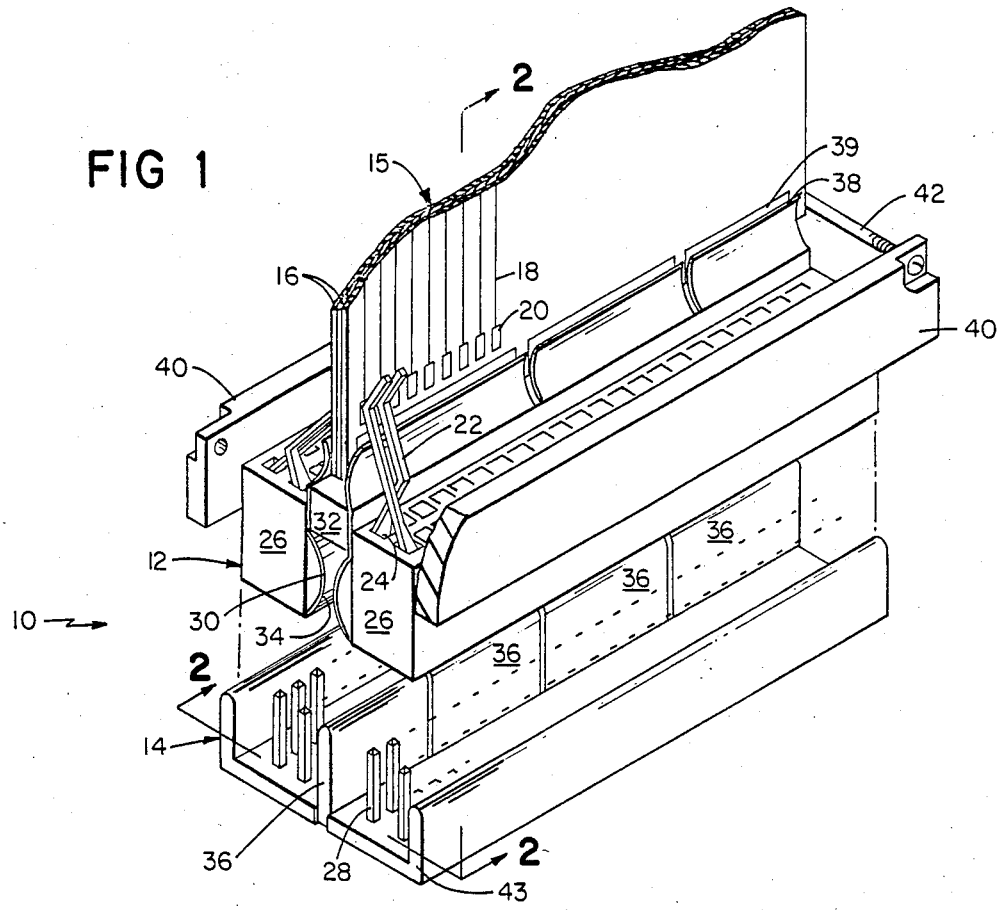
FIG. 1 is a diagrammatic perspective view showing a connector for connecting a daughter printed circuit board to a backplane according to the invention.
Figure 2:
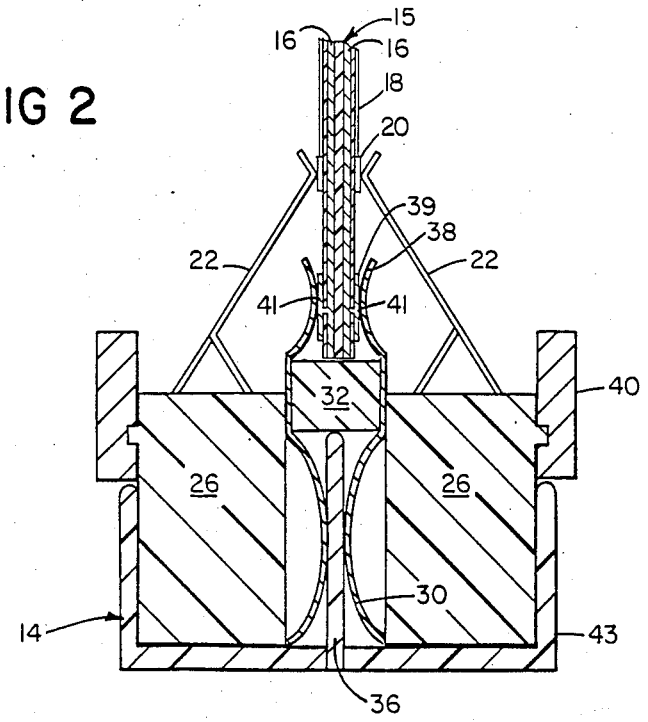
FIG. 2 is a diagrammatic vertical sectional view, taken at 2—2 of FIG. 1, of the FIG. 1 connector.

Referring to FIGS. 1 and 2, there is shown two-piece daughter board-backplane connector 10 including daughter board connector element 12 and backplane connector element 14. Daughter board connector element 12 is connected to multilayer impedance controlled daughter board 15 including two internal ground plane layers 16 and signal lines 18 and signal pads 20 on both of its surfaces. Two rows of signal contacts 22 on each side of daughter board 15 are soldered at their upper ends to signal pads 20 and have forked lower ends within rectangular cross-section passages 24 of plastic members 26. Alternate contacts 22 are bent so as to be divided into two rows of equal length contacts.

Ground contacts 30 (phosphor bronze, spring stock) are mounted between plastic members 26, are spaced by plastic spacer 32, and have gold plating on their curved contacting surfaces 34 that contact elongated bus bar 36 (0.025" thick phosphor bronze, gold plated) of backplane connector 14. Ground contacts 30 overlap a plurality of adjacent signal contacts. Upper portions 38 of ground contacts 30 are electrically connected to conductors 39 printed on both surfaces of daughter board 15 along its bottom. Printed conductors 39 are in turn electrically connected to internal grond plane layers 16 by plated-through via holes 41 (about 0.020" in diameter). As internal ground plane layers 16 are located at a very short distance from the surfaces, the effect of conduction through the via holes on the electrical performance is very small. Plastic members 26 are held together by aluminum stiffeners 40, which are connected together by bolts 42. Post contacts 28 (0.025" square) mate with corresponding forked contacts 22 and have portions underneath insulating members 43 that directly make electrical contact with the backplane (not shown) underneath it. Bus bars 36 similarly have portions extending underneath them that directly make electrical contact with the backplane.

OPERATION

In operation, daughter board connector element 12 and backplane connector element 14 are mated, ground contacts 30 making electrical contact with bus bars 36, and forked signal contacts 22 making electrical contact with associated post contacts 28. Ground contacts 30 and bus bars 36 in effect continue the internal ground plane layers 16, providing reduced inductance in the ground path, owing to large area and short distance of the ground path, through the connector and reduced changes in impedance, thereby reducing signal reflection caused by impedance changes. Ground contact 30 and bus bar 36 also act as a shield between the signal contacts on the two sides of daughter board 15, eliminating crosstalk from one side of the connector to the other. The invention is particularly advantageous in high-speed circuitry applications where the rise times are in the nanosecond or sub-nanosecond range.

OTHER EMBODIMENTS

Other embodiments of the invention are within the scope of the following claims. For example, aluminum stiffeners 40 need not be used, and plastic members 26 and spacer 32 could be provided as part of an integral component. Also, instead of a single bus bar 36, there could be two spaced bus bars on two metal layers separated by an insulating layer, permitting the bus bars or layers to carry different voltages; the term "bus bar" herein encompasses both bars 36 and metal layers just mentioned.

What is claimed is:

1. A connector assembly for connecting a daughter printed circuit board having an internal conductive ground plane layer to a backplane, said assembly comprising, a daughter printed circuit board having an internal conductive ground plane layer, a daughter board connector element including a plurality of first signal contacts connected to signal lines on a surface of said daughter board near the bottom of said daughter board, said first signal contacts extending outward from said surface and downward, and a ground contact electrically connected to said internal ground plane layer, said ground contact extending along said bottom of said daughter board and downward from said board closer to a plane passing through said ground plane layer than said first signal contacts so as to continue said ground plane layer without interruption by said first signal contacts to provide a short path to ground, and to span a plurality of said signal contacts, said ground contact having an elongated exposed lower contacting portion, and a backplane connector element including a plurality of second signal contacts arranged for mating with respective first signal contacts and a first elongated bus bar aligned with said ground contact so as to contact said contacting portion.

2. The connector assembly of claim 1 wherein said daughter board connector element also has a plurality of third signal contacts on the opposite side of said daughter board from said first signal contacts, and fourth signal contacts carried by said backplane connector element and arranged for mating with said third signal contacts.

3. The connector assembly of claim 2 wherein said daughter printed circuit board has two internal ground plane layers, and said daughter board connector element has a second ground contact and a spacer between said first and second ground contacts.

4. The connector assembly of claim 1 wherein said ground contact has a curved contacting portion and is made of resilient material.

5. The connector assembly of claim 1 wherein said ground contact is electrically connected to said internal ground plane via contact between an elongated surface of said ground contact and an elongated printed surface conductor along the bottom of said daughter board.

6. The connector assembly of claim 2 wherein there are plural rows of signal contacts on both sides of said ground contact.

7. The connector assembly of claim 2 wherein said second and fourth signal contacts are upstanding posts, and said first and third contacts have forked ends for mating with said upstanding posts.

8. The connector assembly of claim 1 wherein said daughter printed circuit board has a second conductive internal layer, and said daughter board connector element has a further contact extending along said bottom of said daughter board so as to overlap a plurality of said signal contacts, said ground contact and said further contact being separated by a spacer between them, and wherein said backplane connector element has a second bus bar spaced from and parallel to said first bus bar, said second bus bar being aligned with said further contact.

9. The connector assembly of claim 8 wherein said first and second bus bars are metal layers carried on opposite surfaces of an insulating layer.

* * * * *